US005316309A

United States Patent [19]

Takeshi

[11] Patent Number: 5,316,309

[45] Date of Patent: May 31, 1994

[54] MEMORY MATCHING GAME WITH MECHANICALLY ACTIVATED ROTATING DISK

[75] Inventor: Sano Takeshi, Saitama, Japan

[73] Assignee: Asahi Corporation, Tokyo, Japan

[21] Appl. No.: 972,122

[22] Filed: Nov. 5, 1992

[30] Foreign Application Priority Data

Nov. 6, 1991 [JP] Japan ..... 3-099027[U]

[51] Int. Cl.[5] ..... A63F 3/00

[52] U.S. Cl. ..... 273/273; 273/138 R; 273/142 R; 434/404; 434/174

[58] Field of Search ..... 273/273, 138 R, 139, 273/142 R, 142 JC, 142 JD, 143 R, 143 D, 280; 434/404, 174, 206

[56] References Cited

U.S. PATENT DOCUMENTS 802,782 10/1905 Hurley ..... 273/142
1,038,178 9/1912 Mills ..... 273/142 R
3,163,426 12/1964 Ruderian .
3,195,896 7/1965 Markham ..... 273/142 R
3,685,831 8/1972 Walss ..... 273/142 R X

*Primary Examiner*—Vincent Millin
*Assistant Examiner*—William M. Pierce
*Attorney, Agent, or Firm*—Salter, Michaelson & Benson

[57] ABSTRACT

A game apparatus is provided for playing a game which tests the memories of game players. The apparatus includes a base, a rotatable disk mounted on the base, and a cover mounted on the base above the disk. A clutch mechanism is provided for rotating the disk, and a braking mechanism is provided for stopping rotation of the disk in one of a plurality of predetermined positions. The cover includes a plurality of spaced apertures and the disk includes a plurality of groups of matched pictures which are oriented so that a plurality of matched pairs of pictures are aligned with the apertures when the disk is stopped in one of the predetermined positions.

7 Claims, 5 Drawing Sheets

MEMORY MATCHING GAME WITH MECHANICALLY ACTIVATED ROTATING DISK

BACKGROUND OF THE INVENTION

The instant invention relates to game apparatus and more particularly to game apparatus for use in playing a game which tests the memory of the players.

It is well known in the toy art that games which test the memories of the players have significant play value. It is also well known in the art that games of this type have significant educational value in that they are capable of strengthening the memories of children. In this regard, a variety of children's memory games have heretofore been known. For example, Milton Bradley Company currently manufactures and markets a line of 5 different memory games including ORIGINAL MEMORY®, ANIMAL FAMILIES MEMORY®, MICKEY MOUSE MEMORY®, MAY I? MEMORY® and MATCH & MOVE MEMORY®. However, these games do not include game apparatus similar to the instant invention and therefore they are believed to be only of general interest. In addition, a variety of adult games have been available which test the memories of the game players.

SUMMARY OF THE INVENTION

The instant invention provides game apparatus for use in playing a game which tests the memory of the players.

Briefly, the game apparatus comprises a base portion, a disk member rotatably mounted on the base portion, a picture wheel mounted on the disk member, and a cover portion mounted over the disk member. The cover portion includes a plurality of spaced apertures and a plurality of door members are hingeably mounted over the apertures. The picture wheel includes a plurality of pairs of matched pictures thereon. A clutch mechanism is provided for rotating the disk member, and it comprises a lever having a gear segment on one end thereof and a transmission gear. When the lever is actuated, the transmission gear is moved into engagement with a gear surface on the hub of the disk member for rotating the disk member. When the lever is released, the transmission gear is disengaged from the gear surface so that the disk member is freely rotatable. A braking mechanism is provided for stopping rotation of the disk member in one of a plurality of predetermined positions. The braking mechanism comprises a cam follower arm and a spring for biasing the cam follower arm into engagement with a multi-faced cam surface on the hub of the disk member. The biased engagement of the cam follower arm with the cam surface is effective for slowing and stopping rotation of the disk member in one of the predetermined positions. The faces of the cam surface, the pictures on the picture wheel and the apertures in the cover are oriented so that whenever the cam follower arm comes to rest on one of the faces of the cam surface, several matched pairs of pictures are aligned beneath the apertures.

For use of the game apparatus in playing a memory game, one player is chosen to play first, and that player pulls the lever to spin the disk. When the disk stops rotating, a plurality of pairs of the matched pictures on the picture wheel are aligned under the closed doors of the cover. The player can then select any two doors and open them to see the pictures therebehind. If the pictures don't match, the player must close the doors, and play passes to the next player. The next player must then pick and open two doors trying to find a pair of matched pictures. If the pictures match, the doors are left open and the player may then pick two new doors to open. If the pictures behind the two new doors also match, the player may again select another pair of doors However, if the pictures don't match, the player must close all of the doors and play passes to the next sequential game player. The first player to match all five pairs of pictures wins the game.

Accordingly, it is an objective of the invention to provide game apparatus for use in playing a game which tests the memories of game players.

It is another object to provide a memory game for children which tests and strengthens the memories of game players.

It is still another object to provide game apparatus including a rotatable disk, a clutch mechanism for rotating the disk, and a braking mechanism for stopping rotation of the disk in one of a plurality of predetermined positions.

It is yet another object to provide game apparatus including a plurality of interchangeable game boards which are mountable on the rotatable disk.

It is a further object of the invention to provide game apparatus which is easy for children to operate.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
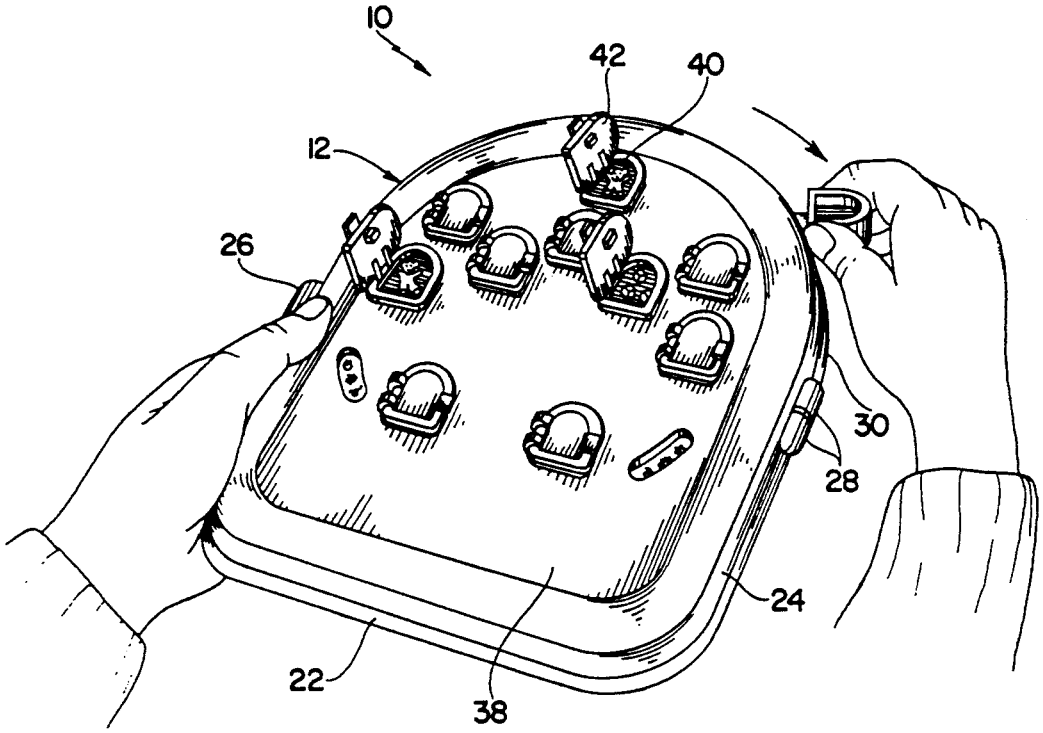
FIG. 1 is a perspective view of the game apparatus of the instant invention.

Referring now to the drawing figures, the game apparatus of the instant invention is illustrated and generally indicated at 10 in FIGS. 1 through 4. The game apparatus 10 comprises a housing generally indicated at 12, a disk member generally indicated at 14 mounted in the housing 12, a picture wheel 16 mounted on the disk member 14, a clutch mechanism generally indicated at 18 for rotating the disk member 14 and a braking mechanism generally indicated at 20 for stopping rotation of the disk member 14 in one of a plurality of predetermined positions.

The housing 12 comprises a base portion 22 and a cover portion 24 which are received in interfitting engagement. The base portion 22 and the cover portion 24 include hinge members 26 so that they are hingeably movable between a closed position illustrated in FIG. 1 and an open position illustrated in FIG. 2, and they further include interlocking tabs 28 which are receivable in engagement to maintain the base portion 22 and the cover portion 24 in the closed position. When the base portion 22 and the cover portion 24 are received in the closed position, they cooperate to define an elongated slot 30 along the side of the housing 12.

The base portion 22 includes a rear wall 32 which is adapted for supporting the game apparatus 10 on a playing surface, such as a table or a floor, and it further includes an arcuate wall segment 34 projecting upwardly from the rear wall 32 and a centrally located spindle 36 which also projects upwardly from the rear wall 32. The cover portion 24 includes a front wall 38 having a plurality of spaced apertures 40 therein. A plurality of door members 42 are hingeably mounted to the outer side of the front wall 38 so that the door members 42 hingeably close over the apertures 40.

Figure 2:
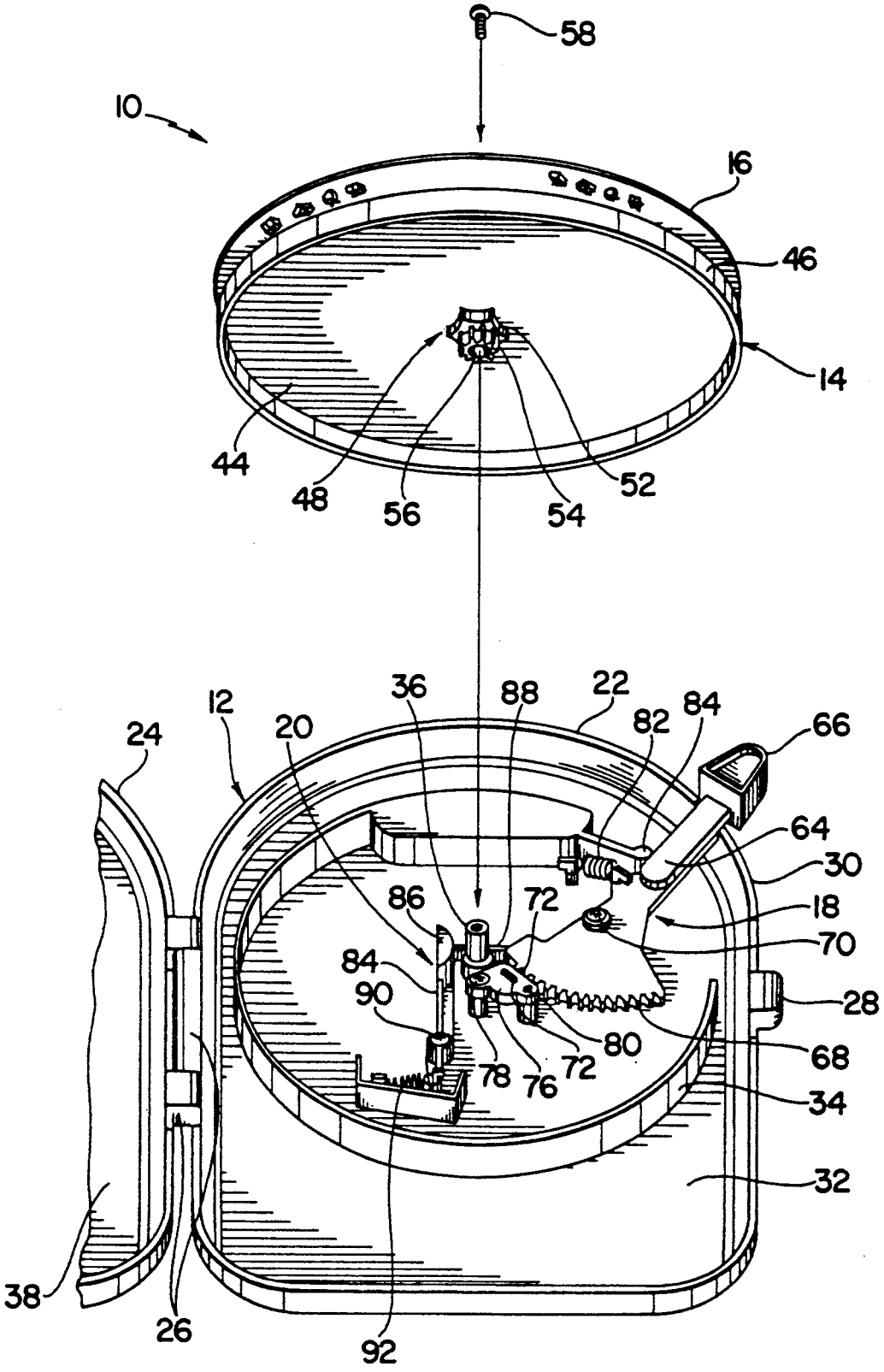
FIG. 2 is a partially exploded view thereof with the cover in an open position and the rotatable disk removed.
Figure 4:
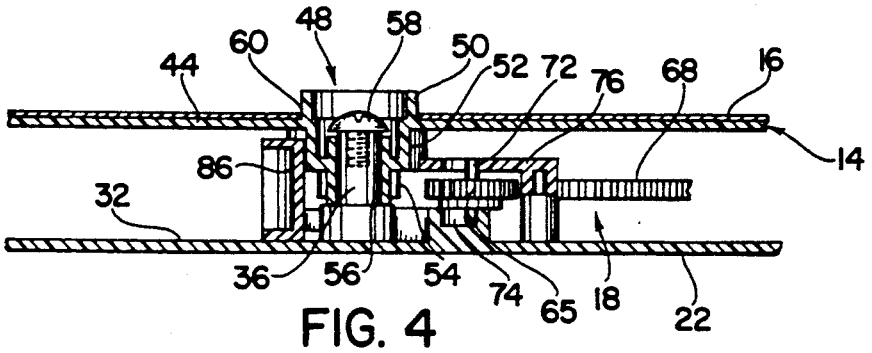
FIG. 4 is a cross sectional view taken along line 4—4 in FIG. 3.
Figure 5:
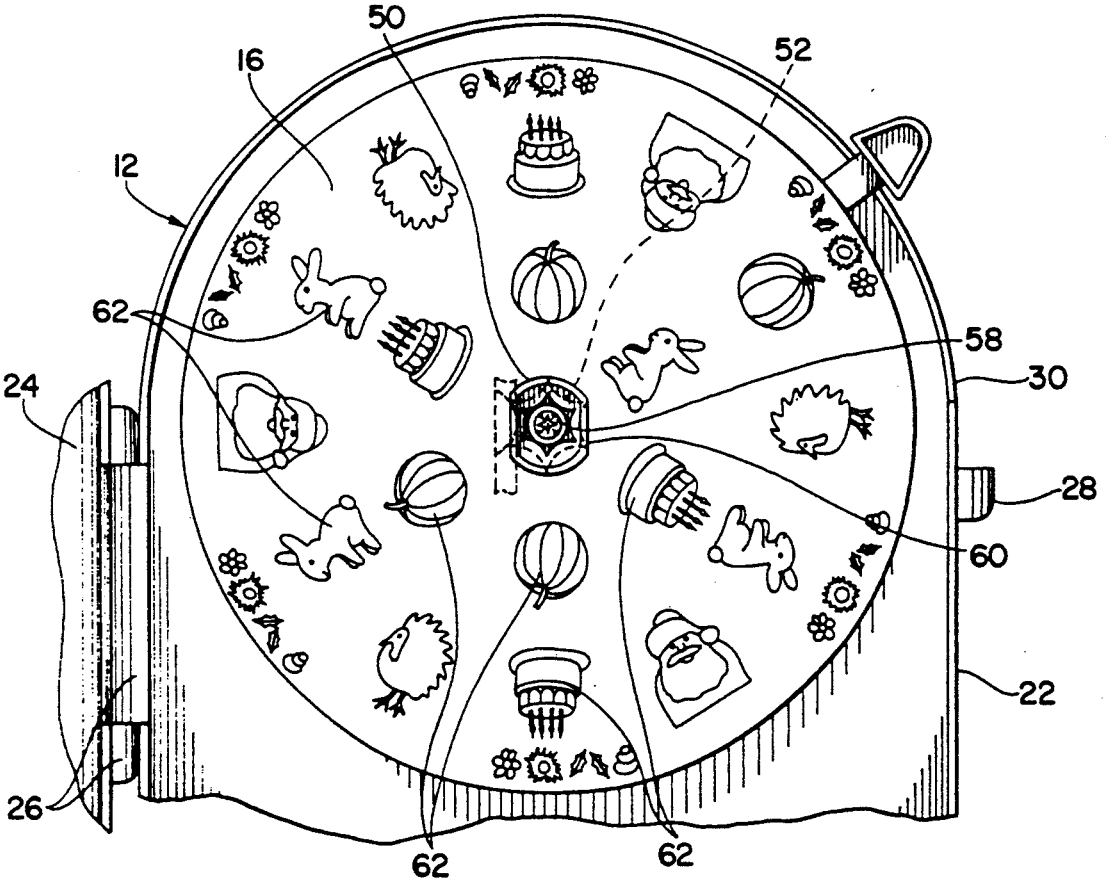
FIG. 5 is a plan view of the rotatable disk with a picture wheel mounted thereon and the braking mechanism partially shown in broken lines.

Referring now to FIGS. 2, 4, and 5, the disk member 14 comprises a circular plate 44 having a cylindrical wall 46 extending downwardly from the peripheral edge thereof and a central hub generally indicated at 48. The hub 48 includes a non-circular pin 50 extending outwardly from an upper side of the plate 44, a multi-faced cam surface 52 extending outwardly from a lower side of the plate 44 and a gear surface 54 also extending outwardly from the lower side of the plate 44. The multi-faced cam surface 52 is generally star-shaped, and it includes six arcuate faces and six peaks. The hub 48 further includes a central bore 56 which is received on the spindle 36 of the base 22 for rotation of the disk 14 thereon. The disk 14 is secured to the spindle 36 by a screw 58.

The picture wheel 16 is preferably formed from a relatively stiff paper board material, and it includes a central aperture 60 which generally corresponds in shape to the pin 50 of the hub 48. The picture wheel 16 is overlayed on the disk 14 so that the aperture 60 engages the pin 50. The non-circular shapes of the pin 50 and aperture 60 are designed so that the picture wheel 16 is maintained in a fixed position relative to the disk 14, i.e. so that it does not rotate with respect to the disk 14. As illustrated in FIG. 5, the picture wheel 16 includes a plurality of groups of fanciful matched pictures 62 which are radially and circumferentially spaced thereon. It is pointed out that there are five different groups or sets of the matched pictures 62 and that each individual picture is actually printed in at least three different locations on the picture wheel 16. For example, in FIG. 5 there are shown three Santa Clauses, three turkeys, four birthday cakes, four pumpkins, and four rabbits. It is also pointed out that when the picture wheel 16 is overlayed on the disk 14, the spaced pictures 62 are positioned in radial alignment with the faces and peaks of the cam surface 52. It will be understood that a plurality of interchangeable picture wheels 16 are normally provided with the game apparatus 10 for increased play value. Each of the picture wheels 16 is preferably reversible so that a first array of matched pictures is printed on one side of a picture wheel and a second array of matched pictures is printed on the second side thereof.

Figure 3:
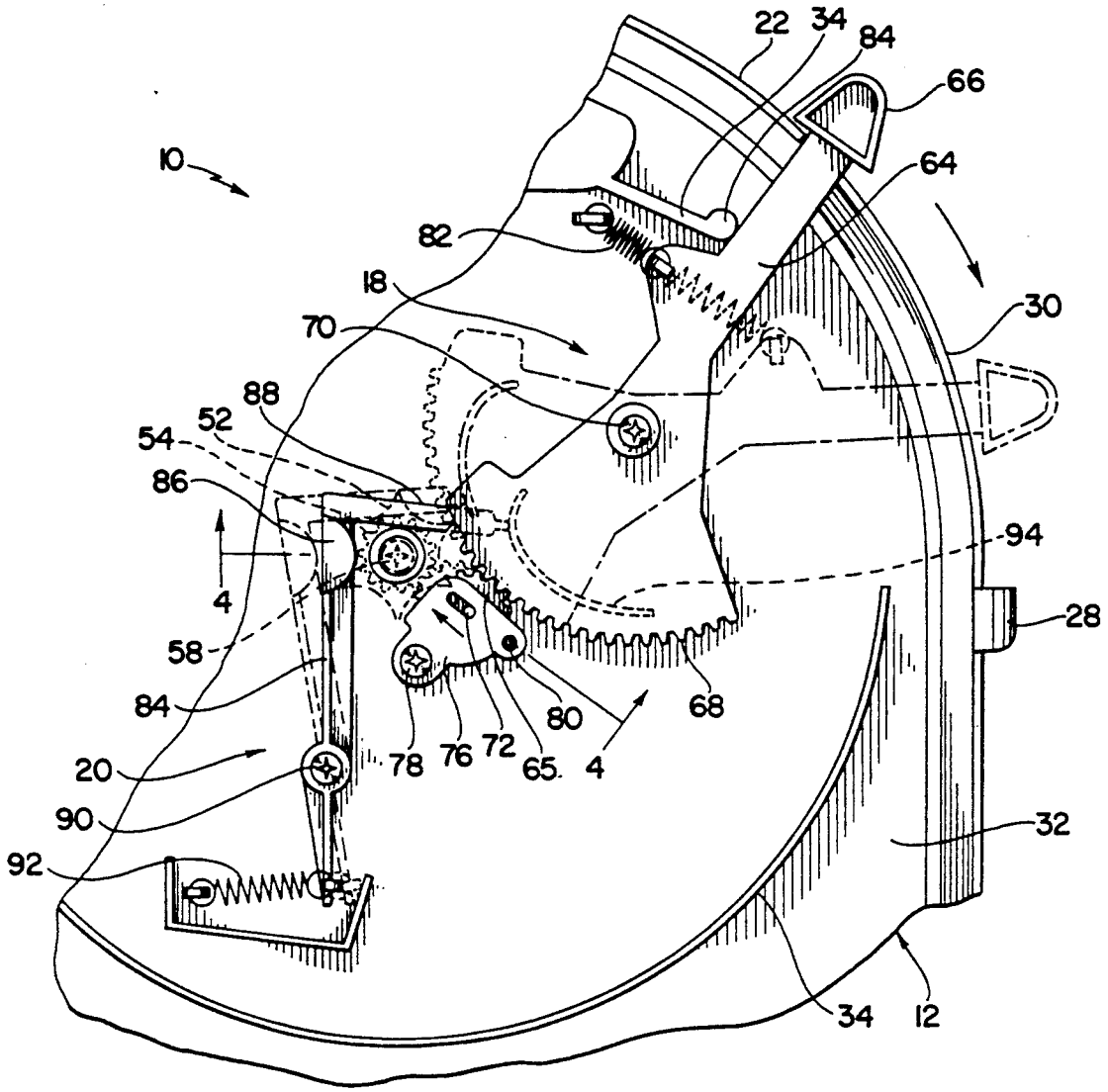
FIG. 3 is an enlarged plan view of the clutch and braking mechanisms of the apparatus.

The clutch mechanism 18 is operable for rotating the disk 14, and it comprises a lever 64 and a transmission gear 65. The lever 64 has a handle 66 at one end thereof and a gear segment 68 at the other end thereof. The lever 64 is pivotably mounted to the base 22 by a screw 70 so that the handle 66 extends outwardly of the housing 12 through the slot 30 and so that the gear segment 68 is positioned adjacent to the spindle 36. The transmission gear 65 is slidably mounted adjacent to the central spindle 36, and it engages the gear segment 68. The transmission gear 65 includes a central spindle 72, which extends outwardly from each side thereof and which is slidably received in a slotted track formed by a slot 74 in the rear wall of the base, and a slotted plate 76 which is mounted to the rear wall 22 by a screw 78 and pin 80. When the disk 14 is received on the spindle 36, the gear surface 54 of the hub 48 is positioned adjacent to the transmission gear 65, but it does not intermesh with the transmission gear 65. For rotation of the disk, the lever 64 is pivotable between a first position (indicated in solid lines in FIG. 3), wherein the transmission gear 65 is withdrawn from engagement with the gear surface 54, and a second position (indicated in broken lines in FIG. 3), wherein the transmission gear 65 is received in engagment with the gear surface 54 of the hub 48. The lever 64 is normally biased to the first position by a spring 82 which is connected to the base 22 at one end, and to the lever 64 at the opposite end. In this manner, when the lever 64 is moved from the first position to the second position, and then released, the lever 64 springs back to the first position. Rearward movement of the lever 64 past the first position is prevented by an enlarged end portion 84 of the wall segment 32 against which the lever 64 is biased. To spin the disk 14, a user grasps the handle 66 as illustrated in FIG. 1, and moves the lever 64 from the first position (FIG. 3 solid lines), to the second position (FIG. 3 broken lines). In this connection, when the lever 64 is moved from the first position towards the second position, the initial movement of the gear segment 68 slides the transmission gear 65 along its track into engagement with the gear surface 54 of the hub 48 and further movement of the lever 64 towards the second position causes intermeshing rotation of the transmission gear 65 and the gear surface 54 for rotation of the disk 14. When the lever 64 is released, the lever 64 automatically springs from the second position back to the first position, wherein movement of the gear segment 68 slides the transmission gear 65 back along its track and out of engagement with the gear surface 54 so that the disk 14 is freely rotatable without interference.

The braking mechanism 20 is operable for stopping rotation of the disk 14 in one of a plurality of predetermined positions, and it comprises a cam follower arm 84 having an arcuate camming head 86 at a first end thereof, and a leg member 88 extending perpendicularly outwardly from the first end thereof. The follower arm 84 is pivotally mounted to the base 22 by a screw 90 so that the camming head 86 is positioned adjacent to the spindle 36. A coil spring 92 connected to a second end of the follower arm 84 biases the camming head 86 into engagement with the multi-faced cam surface 52. The spring 92 also biases a terminal end of the leg member 88 against a bearing surface 94 on the lever 64. When the lever 64 is moved from the first position to the second position, the terminal end of the leg member 88 rides on the bearing surface 94 and moves the camming head 86 out of engagement with the multi-faced cam surface 52 so that the disk 14 is freely rotatable. When the lever 64 is released, the spring 92 biases the camming head 86 back into engagement with the cam surface 52 to slow down and stop rotation of the disk 14. In this regard, the braking mechanism 20 is operative for stopping rotation of the disk in one of a plurality of predetermined positions wherein pairs of the matched pictures 62 are aligned below the apertures 40 in the cover portion 24 of the housing 12. More specifically, the matched pictures 62, the arcuate faces of the cam surface 52, and the apertures 40 in the cover 22 are aligned so that whenever the camming head 86 comes to rest on one of the faces of the cam surface 52, a plurality of pairs of the matched pictures 62 are aligned underneath the apertures 40. Rotation of the picture wheel 16 so that the camming head 86 rests on another face of the cam surface 52 rotates the pictures 62 so that different pairs of matched pictures 62 are aligned with the apertures 40. In this manner, the picture wheel 16 can effectively show six different variations of the five sets of matched pictures 62 for play.

Figure 7:
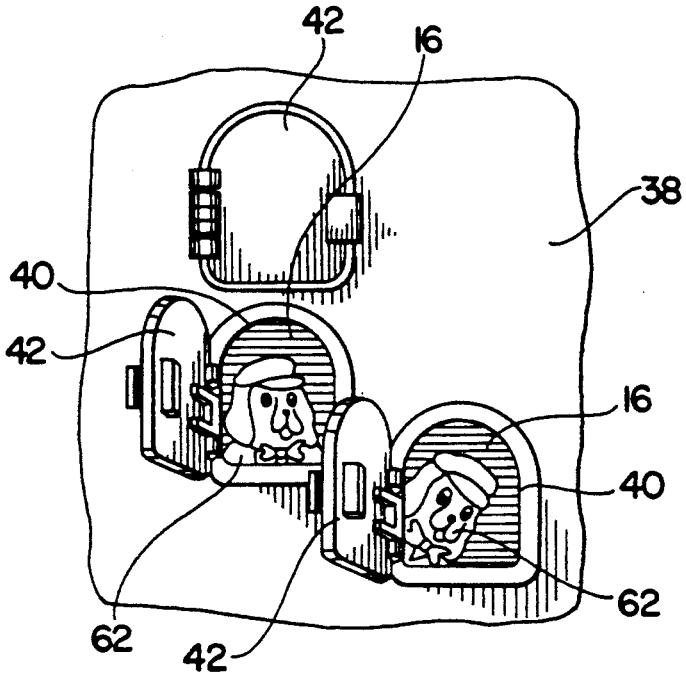
FIG. 7 is a similar view with a pair of matched pictures showing.
Figure 6:
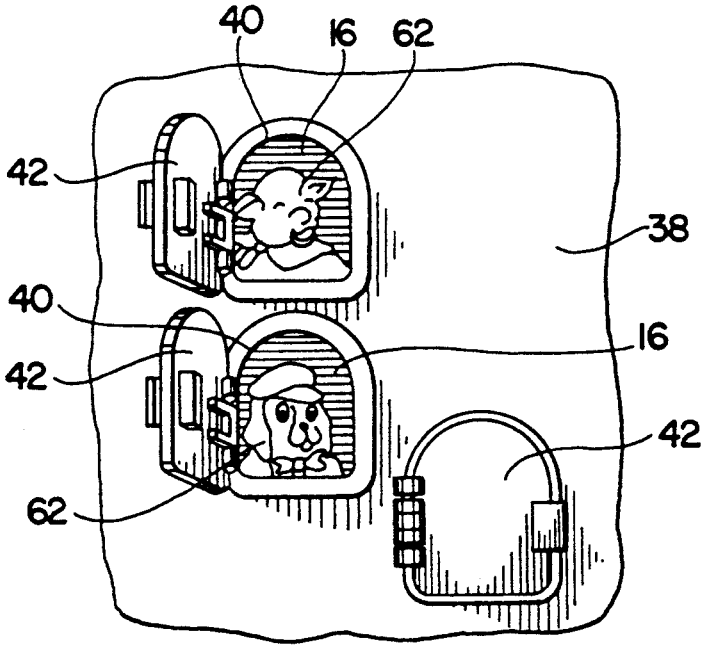
FIG. 6 is an elevational view of three of the hinged doors on the cover portion with a pair of unmatched pictures showing.

For use of the game apparatus 10 in playing a memory game, the players open the cover 24 of the housing 12, choose a picture wheel 16, fit the picture wheel 16 onto the pin 50 of the disk 14 and then close the cover 24. One player is chosen to play first and that player pulls the handle 66, i.e. moves the lever 64 from the first position to the second position, to spin the disk 14. When the disk 14 stops rotating, pairs of the matched pictures 62 are aligned under the closed doors 42 on the cover 24. The player can then pick any two doors 42 and open them so that all of the players can see the pictures 62 therebehind. If the pictures 62 don't match (FIG. 6), the doors 42 must be closed and play passes to the next player. The next player can then pick and open two doors 42 trying to find a pair of matched pictures. If the pictures 62 match (FIG. 7), the doors 42 are left open and the player may select and open two new doors 42. If the pictures behind the two new doors match, the player can again select another pair of new doors. However, once the player opens a pair of doors to expose pictures that don't match, that player must close all of the doors and game play is passed to the next player. The first player to match all five pairs of pictures in a single turn wins the game. In order to start a new game, one of the players must pull the handle 66 to spin the disk 14 so that the pictures 62 are rotated to a new position. Alternatively, the player can reverse the picture wheel to use the array of pictures on the opposite side thereof or still further the player can remove the picture wheel 16 and replace it with another picture wheel. It will be understood that variations of play may also be utilized for further enjoyment.

It is seen therefore, that the game apparatus 10 of the instant invention is useful for playing an amusing memory game which tests the memories of game players. The cover 24 of the apparatus includes a plurality of apertures, and the picture wheel 16 contains a plurality of matched pictures 62 which are radially spaced so that pairs of the matched pictures 62 are aligned underneath the apertures 40 in the cover portion 24 of the housing 12. The clutch mechanism 18 is operative for rotating the disk 14 and the braking mechanism 20 is operative for stopping rotation of the disk 14 in one of a plurality of different positions so that a plurality of pairs of matched pictures 62 are disposed beneath the apertures 40 in the cover portion 24. Each side of the picture wheel is capable of displaying six different variations of the same five sets of matched pictures and each picture wheel is reversible so that two arrays of matched pictures are available for use on each picture wheel.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game apparatus comprising:

a base receivable on a playing surface;

a first disk which is rotatably received on said base;

a second disk including a plurality of groups of matched pictures thereon;

means for releasably mounting said second disk on said first disk in a predetermined rotational position;

a cover received on said base so as to be positioned above said second disk, said cover having a plurality of apertures therein;

a plurality of movable doors on said cover for individually selectively opening and closing said apertures;

means for rotating said first disk; and means for stopping rotation of said first disk in one of a plurality of predetermined positions, said pictures on said second disk and said apertures being oriented such that a plurality of pairs of matched pictures is aligned with said apertures when said first disk is stopped in each of said predetermined positions.

2. In the game apparatus of claim 1, said first disk having a central hub, said means for rotating said first disk comprising:

a gear surface on said central hub:

a lever having a gear segment on one end thereof, said lever being pivotally mounted on said base so that said gear segment is adjacent to said gear surface; and a transmission gear slidably mounted on said base between said gear surface and said gear segment, said transmission gear intermeshing with said gear segment, said lever being pivotably between a first position wherein said transmission gear is withdrawn from intermeshing engagement with said gear surface and a second position wherein said transmission gear intermeshes with said gear surface for rotation of said first disk.

3. The game apparatus of claim 2 further comprising spring means for biasing said lever to said first position.

4. In the game apparatus of claim 1, said first disk including a central hub, said means for stopping comprising:

a cam surface on said hub, said cam surface having a plurality of generally arcuate faces thereon;

a cam follower; and a spring for biasing said cam follower against said cam surface, said cam wheel faces, said plurality of pairs of matched pictures and said apertures in said cover being aligned such that a plurality of matched pairs of said pictures are positioned beneath said apertures when said cam follower is in engagement with one of said faces.

5. In the game apparatus of claim 1, said means for releasably mounting said second disk on said first disk comprising an axial non-circular pin which extends upwardly from said first disk, and a corresponding non-circular axial aperture in said second disk, said aperture being received over said pin so as to prevent relative rotation.

6. A game apparatus comprising:

a base receivable on a playing surface;

a first disk having a central hub which is rotatably received on said base, said central hub including an upwardly facing non-circular pin;

a second disk including a plurality of groups of matched pictures thereon and having a non-circular aperture thereon, said aperture being received over said pin on said first disk so as to position said second disk in a predetermined rotational position on said first disk;

a cover received on said base so as to be positioned above said second disk, said cover having a plurality of apertures therein;

a plurality of movable doors on said cover for individually selectively opening and closing said apertures;

means for rotating said first disk comprising a gear surface on said central hub;

a lever having a gear segment on one end thereof, said lever being pivotally mounted on said base so that said gear segment is adjacent to said gear surface; and a transmission gear slidably mounted on said base between said gear surface and said gear segment, said transmission gear intermeshing with said gear segment, said lever being pivotably between a first position wherein said transmission gear is withdrawn from intermeshing engagement with said gear surface and a second position wherein said transmission gear intermeshes with said gear surface for rotation of said first disk; and mean for stopping rotation of said first disk in one of a plurality of predetermined positions, said pictures on said second disk and said apertures being oriented such that a plurality of pairs of matched pictures is aligned with said apertures when said first disk is stopped in each of said predetermined positions.

7. A game apparatus comprising:

a base receivable on a playing surface;

a first disk having a central hub which is rotatably received on said base, said central hub including an upwardly facing non-circular pin;

a second disk including a plurality of groups of matched pictures thereon and having a non-circular apertures therein, said aperture being received over said pin on said first disk so as to position said second disk in a predetermined rotational position on said first disk;

a cover received on said base so as to be positioned above said seconds disk, said cover having a plurality of apertures therein;

a plurality of movable doors on said cover for individually selectively opening and closing said apertures;

means for rotating said firs disk; and means for stopping rotation of said first disk in one of a plurality of predetermined positions comprising:

a cam surface on said hub, said cam surface having plurality of generally arcuate faces thereon;

a cam follower; and a spring for biasing said cam follower against said cam surface, said cam wheel faces, said plurality of pairs of matched pictures and said apertures in said cover being aligned such that a plurality of matched pairs of said pictures are positioned beneath said apertures when said cam follower is in engagement with one of said faces.

* * * * *